US011335522B2

(12) United States Patent
Carlberg

(10) Patent No.: US 11,335,522 B2
(45) Date of Patent: May 17, 2022

(54) HIGH POWER, SINGLE-USE ELECTRICAL SWITCH

(71) Applicant: Raytheon Company, Waltham, MA (US)

(72) Inventor: Andrew Carlberg, Santa Maria, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 16/857,072

(22) Filed: Apr. 23, 2020

(65) Prior Publication Data

US 2021/0335562 A1 Oct. 28, 2021

(51) Int. Cl.
*H01H 27/00* (2006.01)

(52) U.S. Cl.
CPC ..... *H01H 27/00* (2013.01); *H01H 2227/024* (2013.01); *H01H 2239/062* (2013.01)

(58) Field of Classification Search
CPC ..... H01H 27/00; H01H 2239/062; H01H 2227/024; H01H 1/24; H01H 2003/0293; H01H 2300/046; H01H 27/04
USPC ..... 200/506, 43.01, 43.04, 43.05, 43.19, 200/61.08, 61.19
See application file for complete search history.

(56) References Cited

U.S. PATENT DOCUMENTS

| | | | | |
|---|---|---|---|---|
| 3,702,637 | A * | 11/1972 | Bower | A62C 13/76 169/75 |
| 4,262,180 | A | 4/1981 | Walter | |
| 4,636,603 | A * | 1/1987 | Pliml | H02B 1/048 200/284 |
| 4,672,158 | A | 6/1987 | Baynes et al. | |
| 4,927,787 | A * | 5/1990 | Patel | H01H 27/04 200/506 |
| 7,767,921 | B2 * | 8/2010 | Schloms | H01H 85/08 200/279 |
| 2009/0057118 | A1 * | 3/2009 | Nguyen | G05G 5/08 200/330 |
| 2020/0156519 | A1 * | 5/2020 | Yu | B60N 2/682 |

OTHER PUBLICATIONS

International Search Report and Written Opinion dated May 14, 2021 for corresponding International Application No. PCT/US2021/018720.

* cited by examiner

*Primary Examiner* — Lheiren Mae A Caroc
(74) *Attorney, Agent, or Firm* — Renner, Otto, Boisselle & Sklar, LLP

(57) ABSTRACT

A high power, single-use electrical switch includes a spring-biased plunger contact that mates with a corresponding socket contact, a spacer that provides a separation clearance between the contacts prior to activation of the switch, and a shear tab that supports the spacer and is removed from the switch to enable engagement between the contacts and activation of the switch. Using the shear tab for activation of the switch enables a compact and small form factor assembly that is suitable for use in smaller electronic assemblies.

19 Claims, 3 Drawing Sheets

HIGH POWER, SINGLE-USE ELECTRICAL SWITCH

GOVERNMENT LICENSE RIGHTS

This invention was made with government support. The government has certain rights in the invention.

FIELD OF THE INVENTION

The invention relates to an electrical switch, and more particularly to a single-use switch for a high power application.

DESCRIPTION OF THE RELATED ART

Various applications require single-use electrical switches for high power electronic assemblies. For example, military applications may implement a single-use switch for activation of a deployable payload. Conventional activation switches that are suitable for use with a high power assembly typically use large mechanisms that enable the switches to be used more than once. Due to size constraints, conventional high power switches may be deficient in smaller assemblies.

SUMMARY OF THE INVENTION

A high power, single-use electrical switch includes a spring-biased plunger contact that mates with a corresponding socket contact, an insulated spacer that provides a separation clearance between the contacts prior to activation of the switch, and a shear tab that supports the spacer and is removed from the switch to enable engagement between the contacts during activation of the switch. Using the spacer for separation of the contacts and the shear tab for activation of the switch enables a compact and small form factor switch that is suitable for use in smaller electronic assemblies with high power requirements.

Frangible fasteners are used to removably attach the shear tab to a switch housing that supports the contacts. The shear tab may be formed of a metal material and the frangible fasteners may be formed of an insulated material that is electrically non-conductive. When force is applied to an end of the shear tab that extends away from the housing, the frangible fasteners break to enable removable of the shear tab and the spacer relative to the housing and the contacts of the switch.

When the spacer is removed, the spacer no longer applies a counterforce against the biasing force that pushes the plunger contact toward the socket contact. Accordingly, the plunger contact is pushed against the socket contact for engagement. The contacts are formed with complementary mating surfaces that position the contacts during engagement and ensure continuous electrical contact therebetween.

According to an aspect of the invention, an electrical switch includes spring-biased contacts and an insulated spacer that separates the contacts prior to activation of the electrical switch.

According to an aspect of the invention, an electrical switch includes a shear tab that is removably attached to a contact housing and configured to activate the electrical switch.

According to an aspect of the invention, an electrical switch includes frangible fasteners that break in response to a force during activation of the switch.

According to an aspect of the invention, an electrical switch includes contacts that have complementary mating surfaces for locating the contacts and maintaining continuous electrical contact therebetween.

According to an aspect of the invention, an electrical switch includes a spring-biased cylindrical plunger contact and a socket contact.

According to an aspect of the invention, an electrical switch is a high power, single-use switch that is configured for only closing an electrical circuit in an electronic assembly.

According to an aspect of the invention, an electrical switch includes a housing, first and second electrical contacts supported by the housing, a shear tab removably attached to the housing, and a spacer supported by the shear tab and configured to provide a separation clearance between the first and second electrical contacts, wherein the shear tab is detachable from the housing to remove the spacer from the electrical switch and enable engagement of the first and second electrical contacts during activation of the electrical switch.

According to an embodiment of any paragraph(s) of this summary, the first and second electrical contacts are biased toward each other and the spacer is configured to act against a biasing force.

According to an embodiment of any paragraph(s) of this summary, the first and second electrical contacts have complementary mating surfaces.

According to an embodiment of any paragraph(s) of this summary, the first electrical contact is formed as a cylindrical plunger and the second electrical contact is formed as a socket that receives the plunger.

According to an embodiment of any paragraph(s) of this summary, the plunger has a chamfered peripheral surface and the socket has a countersunk hole that is matingly engageable with the chamfered peripheral surface.

According to an embodiment of any paragraph(s) of this summary, the electrical switch includes a biasing spring that surrounds the plunger to bias the plunger toward the socket.

According to an embodiment of any paragraph(s) of this summary, the spacer and the plunger are engageable along a common longitudinal axis.

According to an embodiment of any paragraph(s) of this summary, the electrical switch includes at least one frangible fastener configured to secure the shear tab to the housing prior to activation of the electrical switch.

According to an embodiment of any paragraph(s) of this summary, at least one frangible fastener is formed of a polyoxymethylene material.

According to an embodiment of any paragraph(s) of this summary, the spacer is a screw formed of an insulating material.

According to an embodiment of any paragraph(s) of this summary, the shear tab has a length that is elongated relative to a width of the shear tab and protrudes from the housing.

According to an embodiment of any paragraph(s) of this summary, the shear tab is formed of a metal material.

According to an embodiment of any paragraph(s) of this summary, the electrical switch includes an insulated base plate arranged between the housing and the shear tab.

According to an embodiment of any paragraph(s) of this summary, one of the first and second electrical contacts is sandwiched between the housing and the insulated base plate.

According to an embodiment of any paragraph(s) of this summary, the spacer extends through the shear tab, the insulated base plate, and the second electrical contact to engage the first electrical contact.

According to an embodiment of any paragraph(s) of this summary, one of the first and second electrical contacts is axially slidable through the housing in a direction that is perpendicular to a plane in which the shear tab extends.

According to another aspect of the invention, an electronic assembly includes a control circuit, an electrical switch arranged along the control circuit and including first and second electrical contacts that are biased toward each other and a removable spacer configured to provide a separation clearance between the first and second electrical contacts prior to activation of the electrical switch, and a shear tab removably attached to the electrical switch and configured to remove the spacer from the electrical switch, wherein during activation of the electrical switch, the shear tab is forcibly removed from the electrical switch to enable removal of the spacer and engagement of the first and second electrical contacts thereby closing the control circuit.

According to still another aspect of the invention, a method of activating an electronic assembly includes biasing first and second electrical contacts toward each other, maintaining a separation clearance between the first and second electrical contacts prior to activation of the electrical switch using a shear tab that supports a spacer, and exerting a force against the shear tab to remove the spacer thereby enabling engagement of the first and second electrical contacts.

According to an embodiment of any paragraph(s) of this summary, the method includes securing the shear tab to a housing that supports the first and second electrical contacts by at least one frangible fastener, and breaking the frangible fastener by exerting the force against the shear tab.

According to an embodiment of any paragraph(s) of this summary, the method includes positioning the first and second electrical contacts during engagement using complementary mating surfaces formed on the first and second electrical contacts.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

The principles described herein have particular application in high power electronic assemblies and systems. A high-power, single-use switch as described herein may be suitable for use in any environment, such as in underwater, air, and space environments. The switch may be configured to satisfy the requirements of a particular application, such as size, weight, power, and cooling requirements. Exemplary applications include military applications that use a single-use switch for activating a payload. Other non-military electronics applications may also be suitable.

Figure 1:
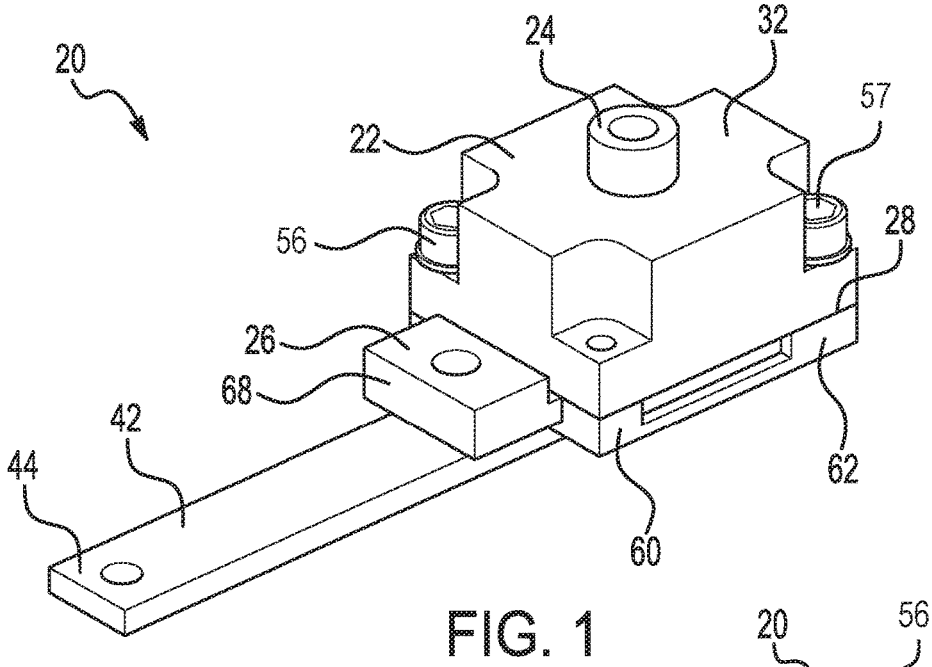
FIG. 1 shows an oblique view of an electrical switch for activation of a component in an electronic assembly.
Figure 2:
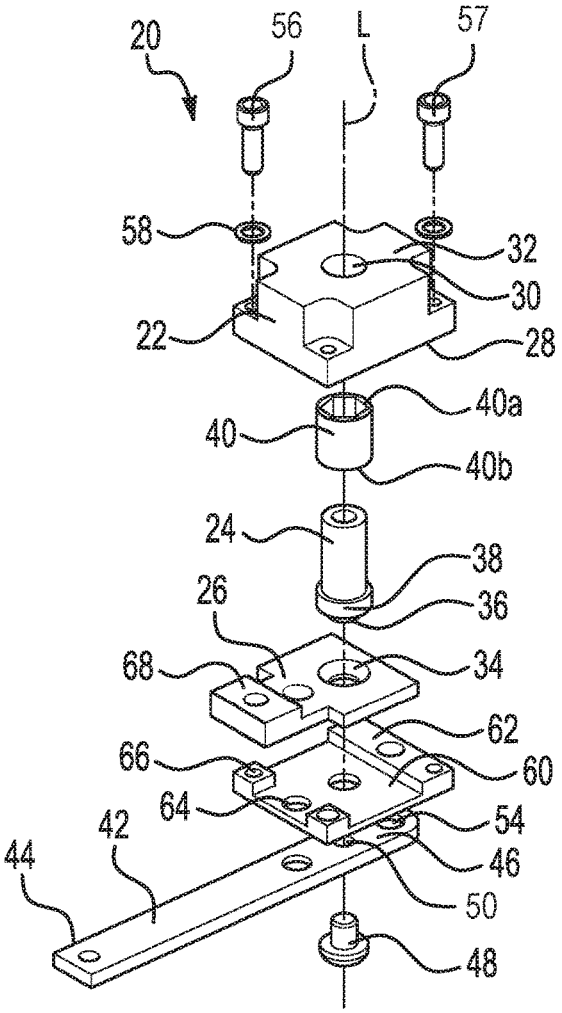
FIG. 2 shows an exploded view of the electrical switch of FIG. 1.

Referring first to FIGS. 1 and 2, an electrical switch 20 for activating a component of an electronic assembly is shown. FIG. 1 shows the electrical switch 20 as assembled and prior to activation. FIG. 2 shows an exploded view of the assembled electrical switch 20. The electrical switch 20 includes a cover or housing 22 that is formed of an insulating material and configured to support the components of the electrical switch 20, such as the electrical conducts that enables electrical communication. Exemplary insulating materials include ceramic and plastic materials or any other electrically non-conductive material. The housing 22 may have any suitable shape and defines an internal volume that accommodates at least one contact of the electrical switch 20. In an exemplary embodiment, the housing 22 may be rectangular in shape.

A first electrical contact 24 and a second electrical contact 26 are provided. The first and second electrical contacts 24, 26 are metallic and engageable for electrical communication therebetween. Exemplary metallic materials for the electrical contacts 24, 26 include silver, copper, gold, platinum, palladium, or any other suitable electrically conductive material. Engagement of the first and second electrical contacts 24, 26 occurs when the electrical switch 20 is activated to close an electrical circuit in which the electrical switch 20 is implemented. Any suitable power source may be arranged in the electrical circuit and the power supply is configured to supply current to the first and second electrical contacts 24, 26. In an exemplary embodiment, the electrical switch 20 is a single-use switch such that the electrical contacts 24, 26 are configured to only engage once and close the circuit, in contrast to conventional switches that are configured to repeatedly open and close a circuit.

When the electrical switch 20 is assembled, the electrical contacts 24, 26 are first biased toward each other and then separated by a spacer that acts against the biasing force to disengage the electrical contacts 24, 26 prior to activation of the electrical switch 20. After activation of the electrical switch 20, which is further described below, the spacer is discarded from the electrical switch 20 and the electrical contacts 24, 26 are then able to engage each other. The electrical contacts 24, 26 are configured to maintain continuous contact with each other during engagement to ensure that the electrical circuit is closed and the component of the electronic assembly is reliably activated.

The electrical contacts 24, 26 are supported by the housing 22. At least the first electrical contact 24 is accommodated within the housing 22 such that the housing 22 at least partially surrounds the first electrical contact 24. The second electrical contact 26 may extend along a side 28 of the housing 22 such that the housing 22 is outside of and adjacent to the second electrical contact 26. The electrical contacts 24, 26 may have any suitable shape. In an exemplary embodiment, the first electrical contact 24 may be formed as a cylindrical plunger and the second electrical contact 26 may be formed as a socket.

The first electrical contact 24 may define a longitudinal axis L, as shown in FIG. 2. The internal volume of the housing 22 may include a through-hole 30 through which the first electrical contact 24 extends, such that the through-hole 30 is also arranged along the longitudinal axis L. A portion of the first electrical contact 24 extends outside of the housing 22 for connection with part of the electrical circuit. The portion of the first electrical contact 24 that extends outside of the housing 22 may be the electricity-receiving end of the electrical contacts 24, 26 such that, when the electrical contacts 24, 26 are engaged, the electricity of the circuit first flows to the first electrical contact 24 outside of the housing 22, through the first electrical contact 24 inside of the housing 22, and toward the second electrical contact 26 which is arranged outside of the housing 22.

The first electrical contact 24 may extend from an opposite side 32 of the housing 22 relative to the side 28 of the housing 22 along which the second electrical contact 26 extends. The second electrical contact 26 may be formed as a planar socket that extends in a plane arranged perpendicular to the longitudinal axis L. Any suitable shape may be used for the second electrical contact 26. For example, a rectangular shape may be suitable. A length and a width of the second electrical contact 26 may be greater than a thickness of the second electrical contact 26 such that the socket is plate-like in shape.

The first and second electrical contacts 24, 26 are formed to have complementary mating surfaces that enable the first and second electrical contacts 24, 26 to continuously contact each other when engaged. In an exemplary embodiment, the second electrical contact 26 is formed to have a countersunk hole 34 that is tapered along the longitudinal axis L in a direction away from the first electrical contact 24 to form a seat for the first electrical contact 24. The first electrical contact 24 has a corresponding chamfered peripheral surface 36 formed on a head 38 of the plunger that is formed at an opposite end of the first electrical contact 24 relative to the portion that extends outwardly from the housing 22. The chamfered peripheral surface 36 is matingly engageable against the countersunk hole 34 when the first and second electrical contacts 24, 26 are engaged.

The complementary mating surfaces between the first and second electrical contacts 24, 26 are used to locate the first and second electrical contacts 24, 26 to provide alignment of the electrical contacts 24, 26 during engagement. The alignment may occur axially along the longitudinal axis L such that the first and second electrical contacts 24, 26 are prevented from being offset relative to the longitudinal axis L. Any suitable complementary mating surfaces may be formed on the first and second electrical contacts 24, 26 and the surfaces may be formed integrally with the corresponding electrical contact 24, 26. For example, other exemplary complementary surfaces may include tongue and groove surfaces, a pin and hole arrangement, male and female couplers, snap-fit connectors, or any other mating surfaces that are suitable to provide electrical contact between the electrical contacts.

During assembly of the electrical switch 20, the first and second electrical contacts 24, 26 are biased toward each other. In an exemplary embodiment, a biasing member 40 is supported in the housing 22 and configured to bias the movable first electrical contact 24 toward the fixed second electrical contact 26. The biasing member 40 may be fully enclosed in the housing 22 and any suitable biasing member may be provided. Any type of spring may be suitable. For example, a pre-compressed linear coil spring may be used. In an exemplary embodiment, the biasing member 40 is formed to radially surround the cylindrical plunger that defines the first electrical contact 24, such that one end 40*a* of the biasing member 40 is engaged against the housing 22 and an opposite end 40*b* engages against the head 38. The arrangement of the biasing member 40 around the plunger is advantageous in providing compactness of the assembly.

Activation of the electrical switch 20 is performed using a shear tab 42. The shear tab 42 is removably secured to the housing 22 on an opposite side of the second contact member 26 relative to the housing 22. The shear tab 42 has an elongated length relative to a width of the shear tab 42 such that the shear tab 42 laterally protrudes from the housing 22. Any suitable length and width may be used for the shear tab 42, and the shear tab 42 may be formed of any suitable material. A metal such as aluminum may be a suitable material. The protruding shear tab 42 is configured to activate the electrical switch 20 via an external force applied to an end 44 of the shear tab 42 that is opposite to an end 46 where the shear tab 42 is secured to the housing 22.

The shear tab 42 is configured to support at least one insulated spacer 48 and at least one removable fastener that secures the shear tab 42 to the housing 22. The spacer 48 is configured to provide a separation clearance between the first and second electrical contacts 24, 26 when the electrical switch 20 is assembled and prior to activation of the electrical switch 20. The shear tab 42 is formed to have a spacer-receiving recess 50 through which the spacer 48 is inserted. The spacer-receiving recess 50 may be aligned along the longitudinal axis L to ensure that the spacer 48 is axially aligned with the electrical contacts 24, 26. In an exemplary embodiment, the spacer 48 extends along the longitudinal axis L through the shear tab 42 and through the countersunk hole 34 of the second electrical contact 26 to engage the head 38 of the first electrical contact 24.

The spacer 48 may be tightened to exert a counterforce against the biasing force that is provided by the biasing member 40 such that the spacer 48 pushes the mating surface of the first electrical contact 24 away from the mating surface of the second electrical contact 26. A pin, post, screw, or any similar retaining element that is able to be inserted and extend through the housing 22 may be suitable for forming the spacer 48. In other exemplary embodiments, alternative methods of providing separation between the electrical contacts 24, 26 may be used. For example, additional springs, a pressurized chamber, or a piston-type configuration may be used.

The spacer 48 is formed of any suitable insulating material, such as a nylon or polyoxymethylene material. The spacer 48 may be secured to the shear tab 42 such that the spacer 48 is removable with the shear tab 42 relative to the housing 22 and the other components of the electrical switch 20. The spacer 48 may be rotatably screwed or axially press-fit into the shear tab 42. A threaded engagement may be provided to enable tightening of the spacer 48 by rotation. In other exemplary embodiments, the spacer 48 may be formed with the shear tab 42 as an integral and monolithic body. More than one spacer 48 may be provided and the spacer 48 may have any suitable shape.

Figure 3:
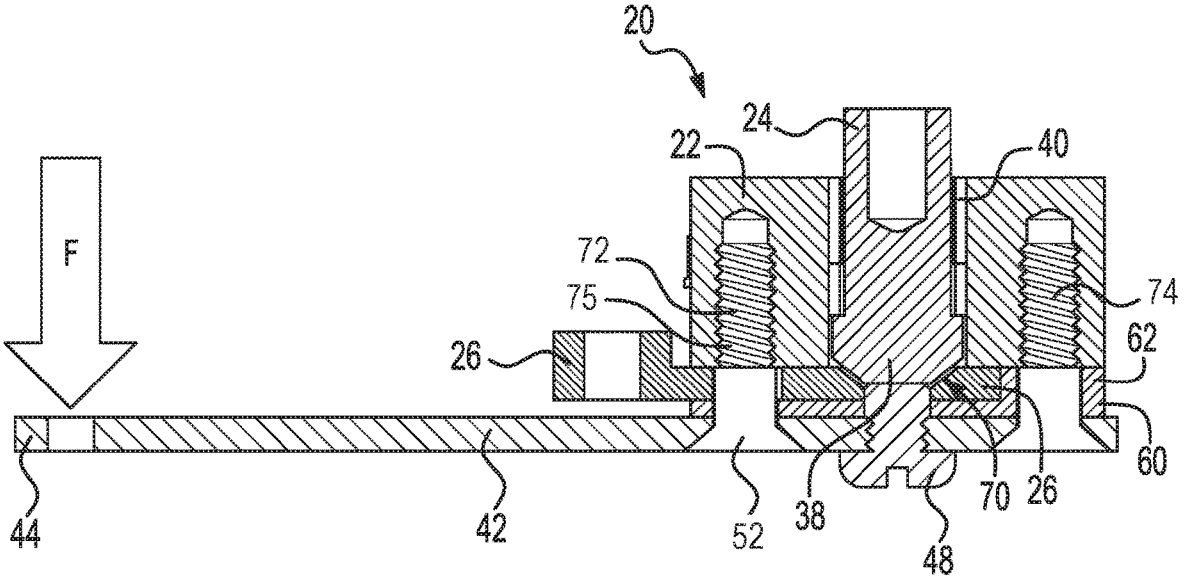
FIG. 3 shows a sectional view of the electrical switch of FIG. 1 when the switch is assembled and prior to activation of the switch.

Referring in addition to FIG. 3, at least one fastener 52 that secures the shear tab 42 to the housing 22 may include two or more fasteners. The fasteners 52 are formed of a frangible material to enable breakage of the fasteners 52 when subject to force during activation of the electrical switch 20. Each of the fasteners 52 may be inserted through a fastener-receiving hole 54 of the shear tab 42 and into the housing 22. In an exemplary embodiment, the fasteners 52 are arranged on opposite sides of the spacer 48.

The frangible fasteners 52 may have any suitable shape. For example, the fasteners may be in the form of a screw, pin, post, or any suitable fastener that is configured to be inserted through the housing 22 and break when subject to a predetermined amount of force. The fasteners 52 are used to secure the shear tab 42 to the housing 22 while the electrical contact 26 is separately secured to the housing 22 via screws 56, 57. Each screw 56, 57 may have a corresponding washer 58 or any other retaining mechanism for securing the contacts within the housing 22.

When force is applied to the end 44 of the shear tab 42 to activate the electrical switch 20, the fasteners 52 are configured to shear. Each fastener 52 is configured such that a portion of the corresponding fastener 52 that is supported in the shear tab 42 will break to enable removal of the shear tab 42 and the spacer 48. The screws 56, 57 (shown in FIGS. 1 and 2) are maintained in the housing 22 and continue to hold the second electrical contact 26 against the housing 22. The fasteners 52 are formed to have any suitable size as dependent on the application. For example, thread sizes of 2-56 (0.218 centimeter or 0.086 inch diameter), 4-40 (0.284 centimeter or 0.112 inch diameter), and 6-32 (0.351 centimeter or 0.138 inch diameter) may be suitable. The fasteners 52 are also formed of a material that enables use in environments having varying temperatures, such as temperatures between approximately −43 degrees Celsius (−45 degrees Fahrenheit) and 70 degrees Celsius (158 degrees Fahrenheit). In an exemplary embodiment, the fasteners 52 may be formed of a nylon or polyoxymethylene material.

The fasteners 52 are formed to have a predetermined tensile strength and area to enable the shearing at the predetermined force. The fasteners 52 may be sheared at an angle between shear and tensile such that the breaking force for the fasteners 52 will be a function of the tensile strength and the tensile area. For example, the fasteners 52 may be formed to have a tensile strength of around 101 MPa (14,700 psi) at −55 degrees Celsius and around 47.6 MPa (6,900 psi) at 70 degrees Celsius, such that the breaking force for a 2-56 thread size fastener 52 may be approximately 80 kilograms per meter (54 pounds per foot) at −55 degrees Celsius and 39 kilograms per meter (26 pounds per foot) at 70 degrees Celsius.

The fasteners 52 are also formed to enable the fasteners 52 to withstand operational vibrations while supporting the weight of the electrical switch 20. A maximum G-force that the fasteners 52 may withstand is defined by the breaking force divided by the mass or weight of the assembly for the electrical switch 20, i.e. the weight that is being supported by the fasteners 52. In an exemplary embodiment, the mass of the assembly may be between 0.11 and 0.18 kilograms (the weight between 0.25 and 0.40 pounds) and the G-force may be approximately 42 G, 69 G, and 104 G for the 2-56, 4-40, and 6-32 screws, respectively. The fasteners 52 may be formed to support any suitable amount of force and weight, and the assembly may be sized up or down as required for a particular application.

An insulated base plate 60 is arranged between the metal shear tab 42 and the second electrical contact 26 to enclose the housing 22, such that the fasteners 52 may also extend through the insulated base plate 60. The base plate 60 prevents the shear tab 42 from directly contacting the housing 22 or the second electrical contact 26. The base plate 60 may be formed of any suitable insulating material and the base plate 60 may be formed of the same material as the housing 22. The housing 22 may be defined as the switch cover that extends over the base plate 60 to enclose the switch components. In other exemplary embodiments, the housing and the base plate may be formed integrally as a monolithic body.

A stepped portion 62 of the base plate 60 may directly engage against the housing 22 and the second electrical contact 26 may engage in the base plate 60 adjacent the stepped portion 62 such that the second electrical contact 26 is enclosed by the housing 22 and the base plate 60. The base plate 60 may be planar and extend in a plane that is parallel with the planes in which each of the second electrical contact 26 and the shear tab 42 extend. Accordingly, the housing 22, the electrical contacts 24, 26, the base plate 60, and the shear tab 42 are stacked along the longitudinal axis L such that the assembly is compact and has a small factor form.

The base plate 60 has a hole pattern 64 for alignment with the holes 50, 54 of the shear tab 42. Pillars 66 are formed on the base plate 60 for supporting a stepped portion 68 of the second electrical contact 26 between the pillars 66 when the electrical switch 20 is assembled. The stepped portion 68 of the second electrical contact 26 is formed to extend outside of the housing 22 such that the stepped portion 68 is configured for connection with the electronic circuit opposite from where the first electrical contact 24 protrudes from the housing 22. The pillars 66 may be formed to be flush with the stepped portion 62 of the base plate 60 such that the stepped portion 62 and the pillars 66 form contact points against the housing 22.

Figure 4:
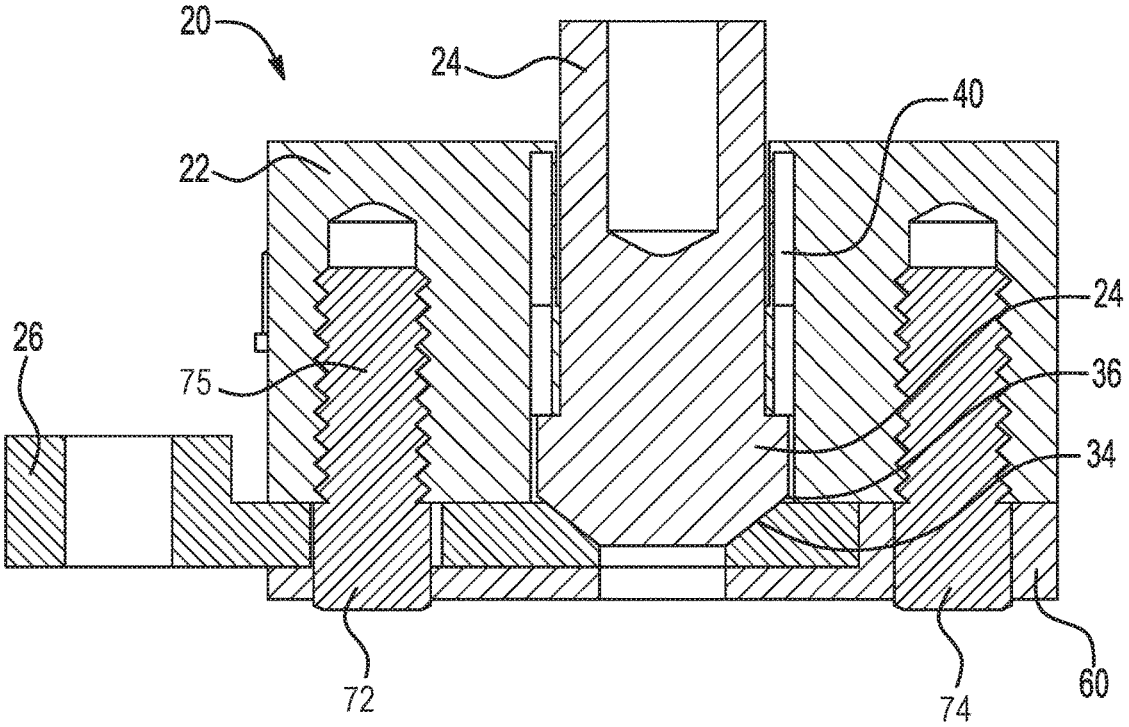
FIG. 4 shows a sectional view of the electrical switch of FIG. 1 after activation of the switch.

Referring to FIGS. 3 and 4, the assembly and activation of the electrical switch 20 is shown. FIG. 3 shows the electrical switch 20 as assembled. When assembled, the spacer 48 is inserted through the shear tab 42, the base plate 60, and the second electrical contact 26 to engage the head 38 of the first electrical contact 24. The spacer 48 pushes against the first electrical contact 24 to act against the biasing force of the biasing member 40 which is pushing the first electrical contact 24 toward the second electrical contact 26 in an opposite direction relative to the direction of force provided by the spacer 48. The first electrical contact 24 is spaced from the second electrical contact 26 by a separation clearance 70 as defined by the spacer 48. The separation clearance 70 may be formed to be larger or smaller via untightening and tightening the spacer 48, respectively. Any suitable separation clearance 70 may be used and the size of the clearance may be dependent on the application. For example, the voltage and power of the electrical circuit, as well as the altitude of the application may impact the size of the separation clearance 70 between the electrical contacts 24, 26.

Prior to activation, the fasteners 52 are inserted through the shear tab 42 and the base plate 60, into the housing 22. Each of the fasteners 52 may have a head that is supported in the shear tab 42. The head may have a widening shape that widens in a direction away from the housing 22 to locate the fastener 52 in the shear tab 42. The head may be attached to another body 72, 74 such as a screw, pin, or other suitable fastener, that extends through the housing 22. The body 72, 74 may have a threaded body 75 for a threaded connection with the housing 22.

The fasteners 52 may extend through the shear tab 42 in a direction that is parallel to the direction in which the first electrical contact 24 extends. Insertion of the fasteners 52 may occur via axial pushing or rotational movement, such as by a threaded connection. One of the fasteners 52 may also be inserted through the second electrical contact 26 which is supported against the portion of the base plate 60 adjacent to the stepped portion 62 of the base plate 60 that directly engages the housing 22.

Activating the electrical switch 20 is performed by applying an external force F to the end 44 of the shear tab 42 that is opposite to and spaced from where the housing 22 for the electrical switch 20 is arranged. The amount of force F is an amount that is able to enable shearing of the fasteners 52 and the force F is dependent on the application. The force F may be applied manually or automatically by a control system in response to a predetermined characteristic change in the surrounding environment. The direction of the force F applied may be dependent on the application. In an exemplary embodiment, the force F is applied in a direction that is parallel to the direction in which the fasteners 52 extend and perpendicular to the plane in which the shear tab 42 extends such that the shear tab 42, the spacer 48, and the fasteners 52 are moved in the direction of the force F.

FIG. 4 shows the electrical switch 20 after activation. The force F is applied to force the shear tab 42 away from the housing 22 and shear the head of each of the fasteners 52 such that the entire shear tab 52 along with the spacer 48 and the fasteners 52 are removed from the electrical switch 20. The bodies 72, 74 are retained in the housing 22. Removing the spacer 48 and the counterforce enables the biasing member 40 to push the first electrical contact 24 against the second electrical contact 24 such that the separation clearance 70 is closed. The chamfered peripheral surface 36 formed on a head 38 of the plunger to matingly engage against the countersunk hole 34 when the first and second electrical contacts 24, 26 engage to ensure alignment of the first and second electrical contacts 24, 26.

Figure 5:
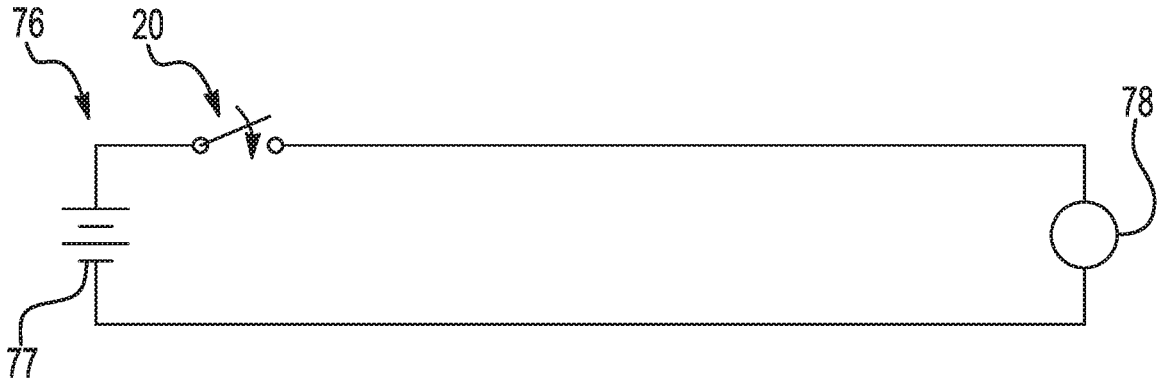
FIG. 5 shows an electrical circuit for the electrical switch of FIG. 1.

Referring in addition to FIG. 5, an electrical circuit 76 for an electronic assembly is shown. The electrical circuit 76 includes the electrical switch 20, a power source 77, and a component 78 to be activated. When the first and second electrical contacts 24, 26 are engaged, the electrical contacts 24, 26 are in continuous electrical communication such that current is able to flow from outside the housing 22 through the protruding end of the first electrical contact 24, through the first electrical contact 24 in the housing 22, and out of the housing 22 through the second electrical contact 26 toward the stepped portion 68 of the second electrical contact 26. During engagement of the electrical contacts 24, 26, the electrical switch 20 is closed to close the electrical circuit 76 and power the component 78. In an exemplary embodiment, the electrical switch 20 is a single-use switch that is only configured to close the electrical circuit 76 one time.

Figure 6:
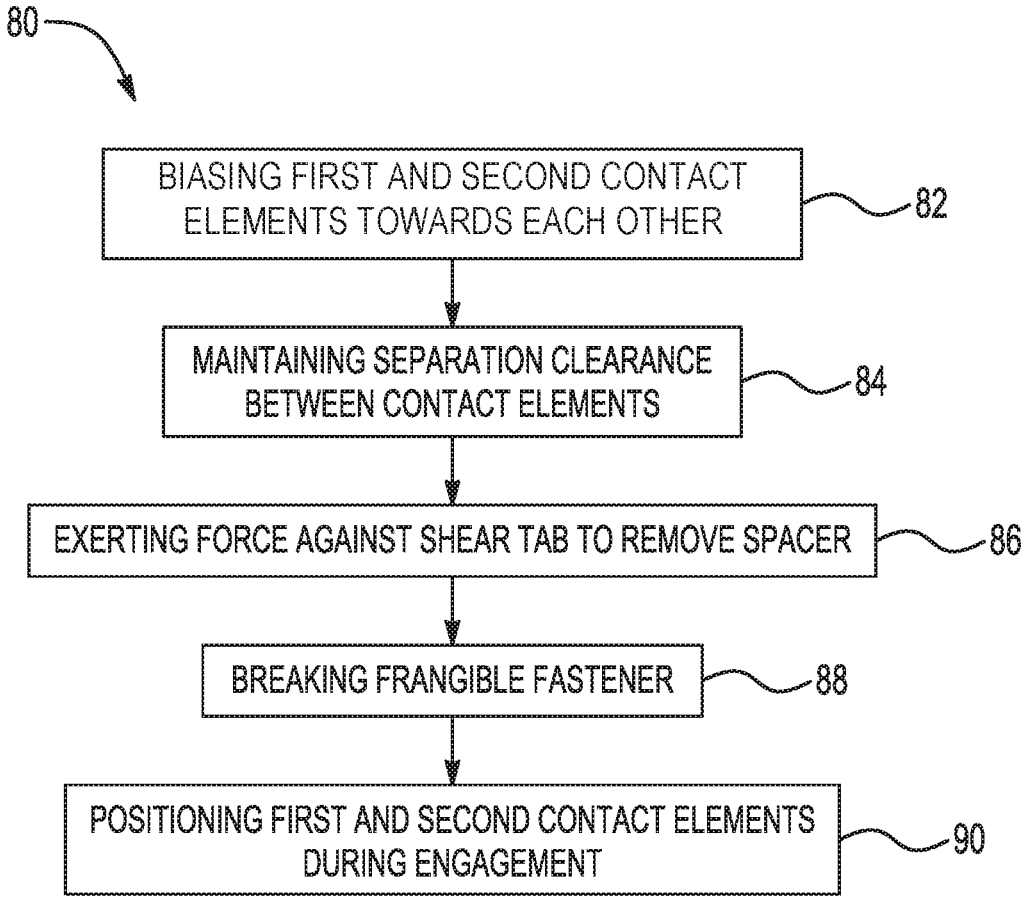
FIG. 6 shows a flowchart of a method for activating a component in an electrical assembly using an electrical switch, such as the electrical switch of FIG. 1.

Referring now to FIG. 6, a flowchart showing a method 80 of activating an electronic assembly is shown. The method 80 may be performed using the electrical switch 20 shown in FIGS. 1-5. A step 82 of the method 80 includes biasing the first and second electrical contacts 24, 26 toward each other. For example, the first electrical contact 24 may be a plunger body that is biased by the biasing member 40 toward the socket body of the second electrical contact 26. A step 84 of the method 80 includes maintaining the separation clearance 70 between the first and second electrical contacts 24, 26 when the electrical switch 20 is assembled and prior to activation of the electrical switch 20. The step 84 may include using the spacer 48 that is supported by the shear tab 42.

A step 86 of the method 80 includes exerting a force against the shear tab 42 to remove the spacer 48 from spacing the first and second electrical contacts 24, 26. A step 88 of the method 80 includes breaking the frangible fasteners 52 that secure the shear tab 42 and the spacer 48 to the housing 22 of the electrical switch 20. Removing the spacer 48 enables engagement of the first and second electrical contacts 24, 26. A step 90 of the method 80 includes positioning the first and second electrical contacts 24, 26 during engagement using complementary mating surfaces formed on the first and second electrical contacts 24, 26. The components of the electrical switch 20 may be manufactured using any suitable methods and processes including injection molding, metal forming, additive manufacturing, or any combination thereof.

The electrical switch described herein is advantageous in that the switch has a reduced overall size that is suitable for smaller, high-powered assemblies. The switch may be sized up or down to accommodate the power required by a particular application. In an exemplary application, the switch may be used in applications that require around 20 amps of power. Using the shear tab activation and the complementary mating engagement between the electrical contacts enables a low profile and reliable switch. The fasteners and spacer are formed of a material that advantageously enables withstanding low and high temperature environments, and supporting the weight of the assembly during normal operational vibrations.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electrical switch comprising:

a housing;

first and second electrical contacts supported by the housing;

a shear tab removably attached to the housing;

a spacer supported by the shear tab and configured to provide a separation clearance between the first and second electrical contacts prior to activation of the electrical switch when the first and second electrical contacts are disengaged, wherein the shear tab is detachable from the housing to remove the spacer from the electrical switch and enable engagement of the first and second electrical contacts during activation of the electrical switch; and at least one frangible fastener configured to secure the shear tab to the housing prior to activation of the electrical switch when the first and second electrical contacts are disengaged, wherein the electrical switch is a single-use switch in which the first and second electrical contacts are configured to only engage once after the electrical switch is activated.

2. The electrical switch according to claim 1, wherein the first and second electrical contacts are biased toward each other and the spacer is configured to act against a biasing force.

3. The electrical switch according to claim 1, wherein the first and second electrical contacts have complementary mating surfaces.

4. The electrical switch according to claim 1, wherein the first electrical contact is formed as a cylindrical plunger and the second electrical contact is formed as a socket that receives the plunger.

5. The electrical switch according to claim 4, wherein the plunger has a chamfered peripheral surface and the socket has a countersunk hole that is matingly engageable with the chamfered peripheral surface.

6. The electrical switch according to claim 4 further comprising a biasing spring that surrounds the plunger to bias the plunger toward the socket.

7. The electrical switch according to claim 4, wherein the spacer and the plunger are engageable along a common longitudinal axis.

8. The electrical switch according to claim 1, wherein the at least one frangible fastener is formed of a polyoxymethylene material.

9. The electrical switch according to claim 1, wherein the spacer is a screw formed of an insulating material.

10. The electrical switch according to claim 1, wherein the shear tab has a length that is elongated relative to a width of the shear tab and protrudes from the housing.

11. The electrical switch according to claim 1, wherein the shear tab is formed of a metal material.

12. The electrical switch according to claim 11 further comprising an insulated base plate arranged between the housing and the shear tab.

13. The electrical switch according to claim 12, wherein one of the first and second electrical contacts is sandwiched between the housing and the insulated base plate.

14. The electrical switch according to claim 13, wherein the spacer extends through the shear tab, the insulated base plate, and the second electrical contact to engage the first electrical contact.

15. The electrical switch according to claim 1, wherein one of the first and second electrical contacts is axially slidable through the housing in a direction that is perpendicular to a plane in which the shear tab extends.

16. An electronic assembly comprising:

a control circuit; and the electrical switch according to claim 1 arranged along the control circuit and including the first and second electrical contacts that are biased toward each other, wherein the removable spacer provides the separation clearance between the first and second electrical contacts prior to activation of the electrical switch, wherein during activation of the electrical switch, the shear tab is forcibly removed from the electrical switch to enable removal of the spacer and engagement of the first and second electrical contacts thereby closing the control circuit.

17. A method of activating an electronic assembly, the method comprising:

biasing first and second electrical contacts toward each other;

maintaining a separation clearance between the first and second electrical contacts prior to activation of the electrical switch when the first and second electrical contacts are disengaged using a shear tab that supports a spacer;

exerting a force against the shear tab to remove the spacer thereby enabling engagement of the first and second electrical contacts, wherein the electrical switch is a single-use switch in which the first and second electrical contacts are configured to only engage once after the electrical switch is activated;

securing the shear tab to a housing that supports the first and second electrical contacts by at least one frangible fastener prior to activation of the electrical switch when the first and second electrical contacts are disengaged; and breaking the frangible fastener by exerting the force against the shear tab.

18. The method according to claim 17 further comprising positioning the first and second electrical contacts during engagement using complementary mating surfaces formed on the first and second electrical contacts.

19. An electrical switch comprising:

a housing;

first and second electrical contacts supported by the housing;

a shear tab removably attached to the housing; and a spacer supported by the shear tab and configured to provide a separation clearance between the first and second electrical contacts, wherein the shear tab is detachable from the housing to remove the spacer from the electrical switch and enable engagement of the first and second electrical contacts during activation of the electrical switch, wherein the spacer is a screw formed of an insulating material.

* * * * *